US009375926B1

(12) United States Patent
Nystrom et al.

(10) Patent No.: US 9,375,926 B1
(45) Date of Patent: Jun. 28, 2016

(54) MEMBRANE BOND ALIGNMENT FOR ELECTROSTATIC INK JET PRINTHEAD

(71) Applicant: Xerox Corporation, Norwalk, CT (US)

(72) Inventors: Peter J. Nystrom, Webster, NY (US); Gary D. Redding, Victor, NY (US); Mark A. Cellura, Webster, NY (US); Andrew W. Hays, Fairport, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/662,451

(22) Filed: Mar. 19, 2015

(51) Int. Cl.
*B41J 2/14* (2006.01)
*B41J 2/16* (2006.01)
*B41J 2/045* (2006.01)

(52) U.S. Cl.
CPC ..... *B41J 2/14314* (2013.01); *B41J 2/04576* (2013.01); *B41J 2/04578* (2013.01); *B41J 2/1623* (2013.01)

(58) Field of Classification Search
CPC . B41J 2/04576; B41J 2/04578; B41J 2/14314
See application file for complete search history.

(56) References Cited

U.S. PATENT DOCUMENTS 5,668,579 A * 9/1997 Fujii ..... B41J 2/04541 347/10
5,821,951 A * 10/1998 Fujii ..... B41J 2/04541 347/10
6,481,073 B1 * 11/2002 Sugahara ..... B41J 2/1609 29/25.35
2006/0114279 A1 * 6/2006 Iwao ..... B41J 2/04506 347/11
2006/0132550 A1 * 6/2006 Sugahara ..... B41J 2/14233 347/71

* cited by examiner

*Primary Examiner* — Justin Seo
(74) *Attorney, Agent, or Firm* — MH2 Technology Law Group LLP

(57) ABSTRACT

An electrostatic ink jet printhead having an electrostatic actuator with improved resistance to adverse effects resulting from misalignment of a body layer to a gap standoff layer. In an embodiment, first and second portions of the gap standoff layer each have a first width and first and second sections of the body have each have a second width that is wider than the first width. Even with an amount of misalignment, the first and second sections of the body layer define nodes for an actuator membrane, thereby maintaining an effective width ($W_E$) of the actuator membrane that is equal to a target width ($W_T$) of the actuator membrane.

18 Claims, 3 Drawing Sheets

MEMBRANE BOND ALIGNMENT FOR ELECTROSTATIC INK JET PRINTHEAD

TECHNICAL FIELD

The present teachings relate to the field of ink jet printing devices and, more particularly, to methods and structures for electrostatically actuated ink jet printheads and a printer including an electrostatically actuated ink jet printhead.

BACKGROUND

Drop on demand ink jet technology is widely used in the printing industry. Printers using drop on demand ink jet technology may use a plurality (i.e., an array) of electrostatic actuators, piezoelectric actuators, or thermal actuators to eject ink from a plurality of nozzles in an aperture plate. In electrostatic ejection, each electrostatic actuator, which is formed on a substrate assembly, typically includes a flexible diaphragm or membrane, an ink chamber between the aperture plate and the membrane, and an air chamber between the actuator membrane and the substrate assembly. An electrostatic actuator further includes an actuator electrode formed on the substrate assembly. When a voltage is applied to activate the actuator electrode, the membrane is drawn toward the electrode by an electric field and actuates from a relaxed state to a flexed state, which increases a volume of the ink chamber and draws ink into the ink chamber from an ink supply or reservoir. When the voltage is removed to deactivate the actuator electrode, the membrane relaxes, the volume within the ink chamber decreases, and ink is ejected from the nozzle in the aperture plate.

One critical aspect of electrostatic actuators is the dimensions of a spacing or gap between the actuator electrode and the membrane. The gap affects both the volume of ink ejected from a nozzle upon removal of the voltage from the actuator electrode and the voltage that must be applied to the actuator electrode to sufficiently deflect the membrane. A gap that is too narrow or too wide will eject either an insufficient or excessive quantity of ink respectively. Further, as the gap height increases, the power that must be applied to the actuator electrode to sufficiently deflect the membrane also increases.

An electrostatic actuator further includes a dielectric gap standoff layer formed over the substrate assembly, and may be formed on portions of the conductive layer that is used to form the actuator electrodes. The membrane is adhered or bonded to an upper surface of the gap standoff to space the membrane from the electrode, and thus a thickness of the gap standoff layer partially determines the gap or spacing between the actuator electrode and the membrane, which is a critical dimension that affects operation of the printhead.

Additionally, an electrostatic actuator can include a body layer that overlies, and is attached to, the membrane and is used for mounting of the nozzle plate that includes a plurality of nozzles. Thus each ink chamber can be defined, at least in part, by the membrane, the body layer, and the nozzle plate.

For most efficient and predictable operation of a printhead, each electrostatic actuator is designed to have a membrane with a target width "$W_T$". The alignment of the body layer to the gap standoff layer in part determines an effective (i.e., operational or functional) width "$W_E$" of the membrane for a particular electrostatic actuator. In a perfectly aligned printhead, the body layer is correctly aligned with the gap standoff layer, and the effective width $W_E$ is equal to the target width $W_T$. When the body layer is correctly aligned with the gap standoff layer, the operational characteristics of the membrane, for example the flex and travel of the membrane during ejection of ink from a nozzle of the nozzle plate, are close to their designed values, and ink is ejected in the proper volume and direction of travel. FIG. 5A depicts an electrostatic actuator 500 of an electrostatic ink jet printhead where the body plate 502 is properly aligned to the gap standoff layer 504. When the body plate 502 is properly aligned to the gap standoff layer 504, the membrane 506 for the electrostatic actuator 500 has a target width of $W_T$ and an effective width of $W_E$, where $W_E=W_T$.

It will be appreciated that each membrane 506 for each individual actuator 500 is formed from a continuous membrane layer that provides a membrane 506 for a plurality of actuators 500. The membrane or diaphragm 506 for each individual actuator 500 is the region that flexes between membrane nodes, wherein the nodes are provided by the individual gap standoff sections 504 and/or the individual body layer sections 502, depending on the alignment of the body layer 502. In FIG. 5A, the membrane nodes are provided by both the gap standoff layer 504 and the body layer 502, as the individual sections of these layers have the same width and are properly aligned.

In contrast, a body layer that is misaligned to the gap standoff layer decreases the effective width of the membrane for every actuator across the printhead. When the body layer is misaligned to the gap standoff layer, the operational characteristics of the membrane deviate from their designed values, and ink droplet volume and direction of travel may be adversely affected. FIG. 5B depicts an electrostatic actuator 510 that is part of an array of similar electrostatic actuators of an electrostatic ink jet printhead, where the body plate 512 is misaligned to the gap standoff layer 514. When the body plate 512 is misaligned to the gap standoff layer 514 as depicted, the membrane 516 for the electrostatic actuator 510 still has a target width of $W_T$, but $W_E$ is decreased such that $W_E<W_T$. The flex and travel of the membrane 516 may be decreased which, in turn, may decrease the volume of the ejected ink droplet and adversely affect the trajectory of the ejected ink droplet, thereby decreasing print quality. In FIG. 5B, the membrane node is provided on the left side of the actuator 510 by the body layer 512, and on the right side of the actuator by the gap standoff layer 514, as the two layers are misaligned.

A method and structure for an electrostatically actuated ink jet printhead that has improved resistance to body layer misalignment and increases print quality, particularly in misaligned printheads, would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

An embodiment of the present teachings can include an electrostatic ink jet printhead having a plurality of electrostatic actuators, wherein each electrostatic actuator includes a substrate assembly and a gap standoff layer attached to the substrate assembly, wherein the gap standoff layer has a first section and a second section spaced from the first section and the first section of the gap standoff layer and second section of the gap standoff layer each have a first width. The electrostatic ink jet printhead can further include an actuator electrode attached to the substrate assembly and interposed between the first section of the gap standoff layer and the second section of the gap standoff layer within an actuator air chamber, an actuator membrane attached to the first section of the gap standoff layer and to the second section of the gap standoff layer, and a body layer attached to the actuator membrane, wherein the body layer comprises a first section and a second section spaced from the first section of the body layer, a distance from the first section of the body layer to the second section of the body layer determines a width of an ink chamber, and the first section of the body layer and the second section of the body layer each have a second width that is wider than the first width. The electrostatic ink jet printhead can further include a nozzle plate comprising an actuator nozzle through which ink is ejected during printing.

In another embodiment, an ink jet printer can include at least one electrostatic ink jet printhead comprising a plurality of electrostatic actuators. Each electrostatic actuator can include a substrate assembly and a gap standoff layer attached to the substrate assembly, wherein the gap standoff layer has a first section and a second section spaced from the first section and the first section of the gap standoff layer and second section of the gap standoff layer each have a first width. The electrostatic ink jet printhead can further include an actuator electrode attached to the substrate assembly and interposed between the first section of the gap standoff layer and the second section of the gap standoff layer within an actuator air chamber, an actuator membrane attached to the first section of the gap standoff layer and to the second section of the gap standoff layer, and a body layer attached to the actuator membrane, wherein the body layer comprises a first section and a second section spaced from the first section of the body layer, a distance from the first section of the body layer to the second section of the body layer determines a width of an ink chamber, and the first section of the body layer and the second section of the body layer each have a second width that is wider than the first width. The electrostatic ink jet printhead can further include a nozzle plate comprising an actuator nozzle through which ink is ejected during printing. The printer can include a printer housing that encases the at least one electrostatic ink jet printhead.

Another embodiment can include a method for forming an electrostatic ink jet printhead comprising a plurality of electrostatic actuators. The method can include forming a gap standoff layer having a first section and a second section attached to a substrate assembly, wherein the first section of the gap standoff layer and second section of the gap standoff layer each have a first width, forming an actuator electrode attached to the substrate assembly and interposed between the first section of the gap standoff layer and the second section of the gap standoff layer, attaching an actuator membrane to the first section of the gap standoff layer and to the second section of the gap standoff layer to form an actuator air chamber, wherein the actuator electrode is within the actuator air chamber, forming a body layer attached to the actuator membrane, wherein the body layer comprises a first section and a second section spaced from the first section of the body layer, and a distance from the first section of the body layer to the second section of the body layer determines a width of an ink chamber, and forming the first section of the body layer and the second section of the body layer to each have a second width that is wider than the first width, and attaching a nozzle plate to the body layer, wherein the nozzle plate comprises an actuator nozzle through which ink is ejected during printing.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. A "node" is a point or line on a membrane or diaphragm that does not flex during operation of a printhead, where the node is the closest point or line to an adjacent non-nodal point or line on the membrane or diaphragm that flexes during operation of the membrane or diaphragm.

An embodiment of the present teachings can provide a method and structure for an electrostatically actuated ink jet printhead that has improved resistance the negative effects of misalignment of a body layer to a gap standoff layer. In an embodiment, some misalignment of the body layer to the gap standoff layer has little or no adverse effects on the size or trajectory of ink droplets ejected from a nozzle of a nozzle plate during printing.

Figure 5A:
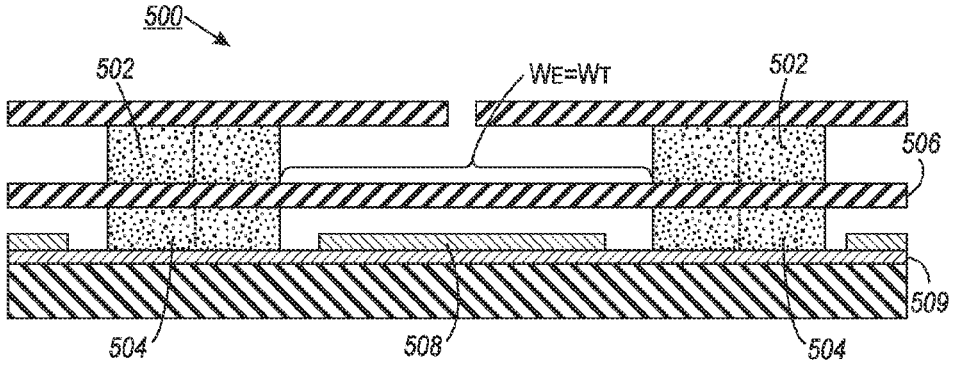
FIG. 5A (Related Art)
FIGS. 5A and 5B are cross sections of conventional devices.
Figure 5B:
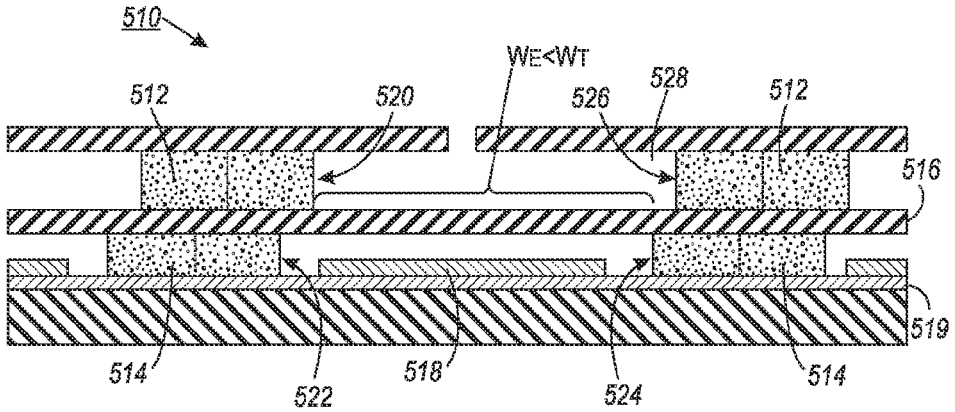
FIG. 5B (Related Art)

As depicted in FIGS. 5A and 5B, it can be seen that a target width of each section of the body layer 502, 512 is the same as the width of each section of the gap standoff layer 504, 514. Methods for forming individual sections of the gap standoff layer 514 and body layer 512 target these structures for the same width. The effective width $W_E$ of the membrane 506 is defined by edges of the body layer 502 and the gap standoff layer 504, more particularly the edge that is closer in a lateral direction to the closest edge of the actuator electrode 518. Because the gap standoff layer 504, 514 is patterned using tight, micron-level mask alignment, the gap standoff layer 504, 514 will be properly aligned with the actuator electrodes 508, 518. As depicted in FIG. 5B, on the left side of the depicted actuator 510, edge 520 of the body layer 512 is laterally closer to the left edge of the electrode 518 than the corresponding edge 522 of the gap standoff layer 514. The left node for membrane 516 is thus provided by edge 520. On the right side of the actuator, edge 524 of the gap standoff layer 514 is laterally closer to the right edge of the electrode 518 than the corresponding edge 526 of the body layer 512, and the right node for membrane 516 is provided by edge 524. The effective width $W_E$ of the membrane 516 is therefore equal to the lateral distance from the body layer edge 520 to the gap standoff edge 524 for the depicted actuator 510. The effective width $W_E$ is thus equal to the target width $W_T$ minus the amount of misalignment of the body layer 512 to the gap standoff layer 514.

An embodiment of the present teachings provides an electrostatically actuated ink jet printhead where each section of the body layer has a substantially different width than each section of the gap standoff layer, thereby decreasing the adverse effects of printhead misalignment. In an embodiment, the effective width $W_E$ of the membrane is not affected by a certain amount of misalignment of the body layer to the gap standoff layer so that the effective width $W_E$ of the membrane is equal to the target width $W_T$, even with misalignment, as will be understood from the description herein.

Figure 1:
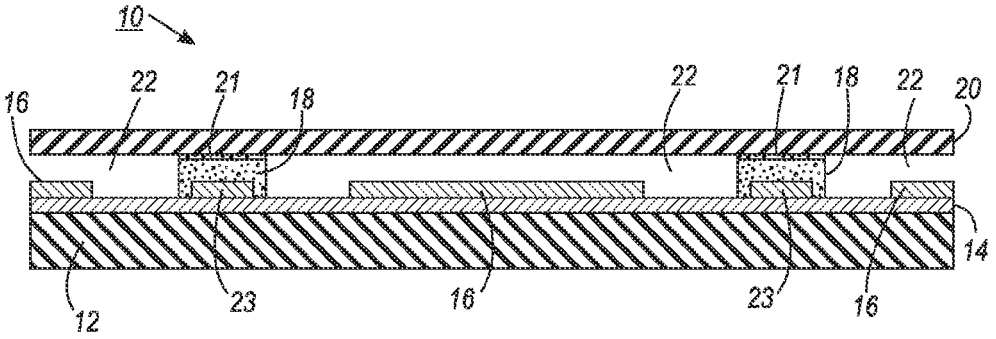
FIGS. 1-3 are cross sections depicting various in-process structures in accordance with an embodiment of the present teachings.
Figure 2:
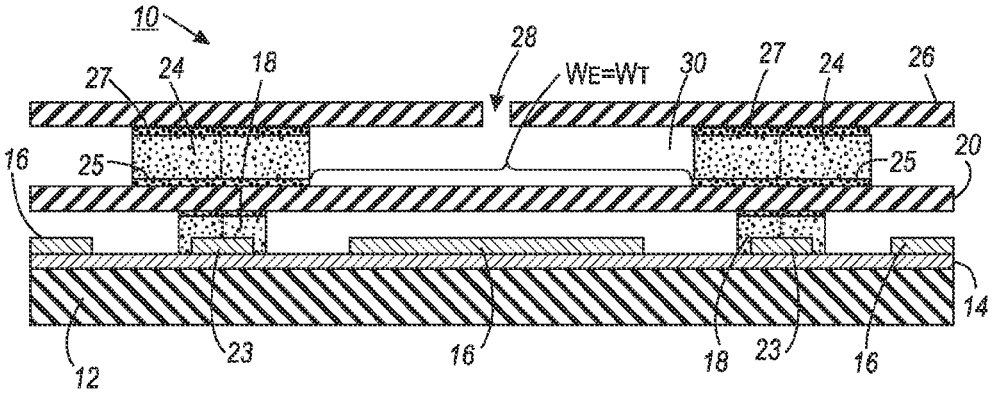
Figure 3:
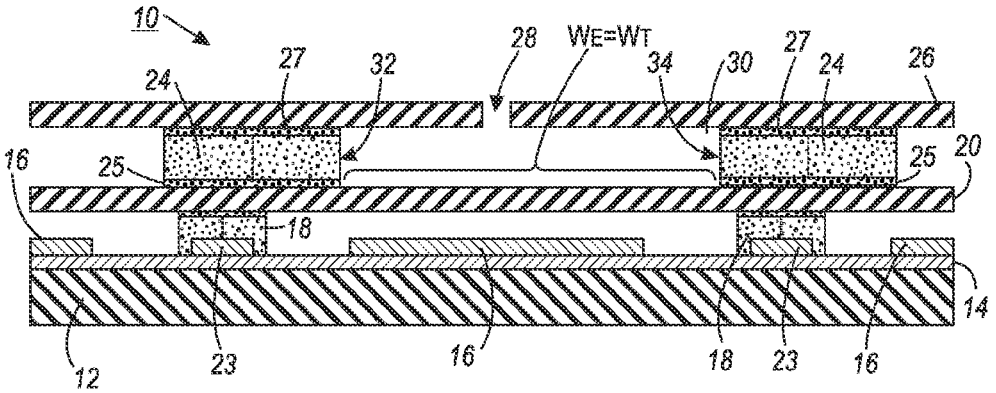

In-process structures which can be formed during an embodiment of the present teachings are depicted in FIGS. 1-3. It will be understood that the FIGS. are generalized schematic depictions and that an actual structure may include other substructures that are not depicted for simplicity, while various depicted substructures may be removed or modified. FIG. 1 depicts an actuator 10 including substrate assembly 12, an electrically insulating blanket dielectric layer 14, an electrically conductive patterned electrode layer 16, first and second spaced sections of a gap standoff layer 18 with the patterned electrode layer 16 interposed therebetween, an actuator membrane or diaphragm 20, and an actuator air chamber 22. In the various embodiments herein, the substrate assembly 12 may include a silicon wafer or wafer section, and may further include various other layers that not depicted for simplicity, such as various doped regions and one or more layers such as an oxide layer on which the blanket dielectric layer 14 is formed.

Further, the structure of FIGS. 1-3 may include a layer 23 interposed between the bottom of the gap standoff layer 18 and the blanket dielectric layer 14 that is equal to, or approximately equal to, the thickness of the patterned electrode layer 16. In an embodiment, layer 23 may be formed from the same layer as the electrode layer 16 and patterned using the same mask and etch, and thus can be the same thickness as the electrode layer 16. In this embodiment, the presence of layer 23 results in the thickness of the gap standoff layer 18 more directly defining the distance from the top of the electrode 16 to the bottom of the diaphragm 20. While FIGS. 1-3 depict the formation of a single actuator 10, it will be understood that hundreds or thousands of actuators may be simultaneously formed on and over the substrate assembly 12.

The blanket dielectric layer 14 may include a nitride layer such as silicon nitride, an oxynitride, or a silicon dioxide between about 0.01 micrometers (μm) and about 1.0 μm thick. The patterned electrode layer 16 may include an aluminum layer, another metal layer, or a doped semiconductor layer between about 0.1 μm and about 0.6 μm thick. The gap standoff layer 18 may include a dielectric having a thickness of from about 0.1 μm to about 2.0 μm. The membrane 20 may be an iron-nickel alloy such as Invar (64FeNi), a silicon layer, a stainless steel layer, a titanium layer, a molybdenum layer, or another suitable material, having a thickness of between about 2.0 μm and about 40 μm, or between about 10 μm and about 20 μm. The gap standoff layer 18 may be physically attached or bonded to the membrane 20 with an adhesive 21. In another embodiment, portions of the electrode layer 14 may remain directly interposed between the gap standoff layer 18 and the substrate assembly 12. Other material compositions, thicknesses, and widths, and other device structures and arrangements of device structures, are contemplated.

The thickness of the gap standoff layer 18, at least in part, defines the distance from the upper surface of the electrode layer 16 to the bottom surface of the membrane 20. This is a distance that is critical to the functionality of the electrostatic actuator and to the printhead. If the membrane 20 is excessively close to the electrode 16, the travel distance of the membrane 20 and the resulting volume and velocity of the ink ejected from the printhead during operation may be insufficient. If the membrane 20 is excessively far from the electrode 16, the voltage required to actuate the membrane 20 and the volume of ink ejected may be excessive.

In an embodiment, a width (e.g., a first width) of each section 18 of the gap standoff layer in the depicted cross section may be from about 3 μm to about 70 μm, or from about 5 μm to about 60 μm, or from about 10 μm to about 50 μm. This surface is sufficiently wide to support the application of the adhesive 21, for example using spray transfer or spin coating techniques. If the width of each section 18 of the gap standoff is excessively narrow, adhesion of the gap standoff layer 18 to the membrane 20 may be insufficient. If the width of each section 18 of the gap standoff is excessively wide, the amount of allowable misalignment with the body layer 24 (FIG. 2) decreases. Other adhesion techniques are contemplated, for example anodic, eutectic, or fusion bonding.

After forming the structure of FIG. 1, a body layer 24 is attached or bonded to the membrane 20 using, for example, an adhesive 25. Further, an aperture plate 26 having a plurality of actuator nozzles 28 is bonded to the body layer 24 using an adhesive 27 as depicted in FIG. 2. It will be understood that the depicted structure is exemplary, as an actual structure can include additional layers, for example, between the body layer 24 and the aperture plate 26. The membrane 20, first and second sections of the body layer 24, and nozzle plate 26 together define an ink chamber 30 of the actuator 10 as depicted that is filled with ink during device operation. For the individual sections of gap standoff layer 18 having the widths described above, the individual body layer sections 24 may have a width (e.g., a second width) of from about 20 μm to about 100 μm, or from about 40 μm to about 90 μm, or from about 50 μm to about 80 μm, for example about 75 μm, respectively. In this embodiment, the widths of the individual body layer sections 24 are targeted to be substantially greater than the widths of the individual gap standoff layer sections 18. In another embodiment, the target widths of each section of the body layer 24 are targeted to be from about 1.2 times to about 5.0 times the width of each individual section of the gap standoff layer 18, or from about 1.5 times to about 4.0 times, or from about 2.0 times to about 3.0 times the width of each individual section of the gap standoff layer 18. In another aspect, the target widths of each section of the body layer 24 are targeted to on the order of from 3 sigma (σ) to 6σ of the alignment capability of the process such that any alignment will fall within an acceptable distribution or yield. In the FIG. 2 embodiment, the body layer 24 is perfectly aligned with the gap standoff layer 18 (e.g., a portion of each section 24 directly overlies one of the sections 18, and a center of each section 24 is directly vertically aligned with a center of the section 18 that it overlies), and the effective width $W_E$ of the membrane 20 is equal to the target width $W_T$. The centers of each section 18, 24 is depicted as a dashed line.

Targeting the width of each section of body layer 24 to be wider than each section of gap standoff layer 18 allows for misalignment of the body layer 24 relative to the gap standoff layer 18 without affecting the target width $W_T$ of the membrane 20. The amount of allowable misalignment increases as the difference in the widths of each section of the body layer 24 to each section of the gap standoff layer 18 increases.

FIG. 3 depicts an embodiment where the body layer 24 is misaligned to the gap standoff layer 18 (e.g., a portion of each section 24 directly overlies one of the sections 18, but the center of each section 24 is not vertically aligned in the same axis with the center of the section 18 that it overlies). As depicted, even with this substantial misalignment, the effective width $W_E$ of the membrane 20 remains equal to the target width $W_T$. In the FIG. 3 embodiment, the nodes of the membrane 20 remain defined by only the body layer 24, specifically edges 32, 34 of the body layer 24, which also defines the width of the ink chamber 30, even with the misalignment. This is in contrast to the FIG. 5B embodiment where, with misalignment, the nodes of membrane 516 are defined in part by the gap standoff layer 514, particularly edge 524, which reduces the effective width $W_E$ of the membrane 516. In FIG. 5B, the body layer 512 that defines the width of the ink chamber 528 does not define the every node of the membrane 516. In FIG. 3, the body layer 24 that defines the width of the ink chamber 30 also defines each node of the membrane 20, even with the misalignment.

Forming the gap standoff layer 18 decrease the width of each section compared to conventional devices does not adversely affect the design of the actuator 10 or change any critical dimensions of the device actuator 10. The width of the ink chamber 30 and the target width $W_T$ of the membrane 20 remain the same. Increasing the width of the actuator air chamber 22 by decreasing the width of the individual sections of the gap standoff layer 18 does not adversely affect the design of the device or add any additional mask steps.

Figure 4:
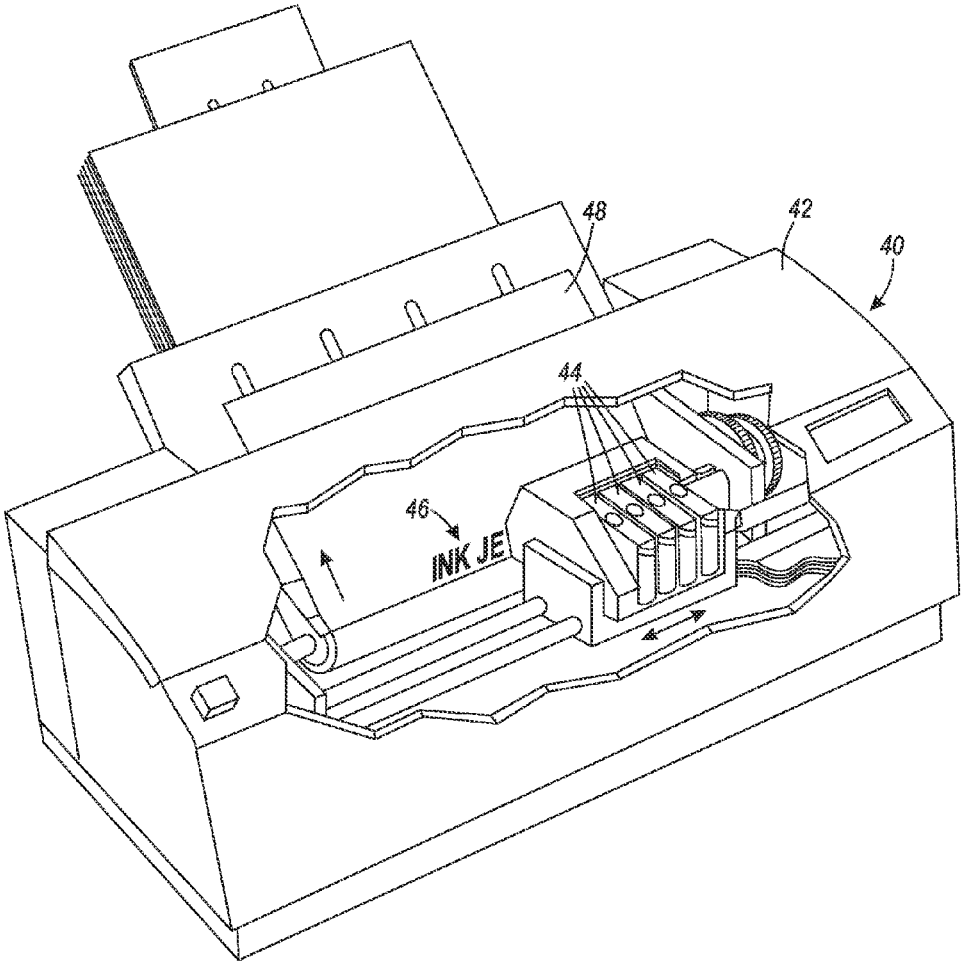
FIG. 4 is a perspective depiction of a printer including one or more electrostatically actuated ink jet printheads according to an embodiment of the present teachings.

FIG. 4 depicts a printer 40 including a printer housing 42 into which at least one printhead 44 including an embodiment of the present teachings, for example a structure similar to that depicted in FIGS. 2 and/or 3, has been installed. The housing 42 may encase the printhead 44. During operation, ink 46 is ejected from one or more nozzles 74 in one or more printheads 44. The printhead 44 is operated in accordance with digital instructions to create a desired image on a print medium 48 such as a paper sheet, plastic, etc. The printhead 44 may move back and forth relative to the print medium 48 in a scanning motion to generate the printed image swath by swath. Alternately, the printhead 44 may be held fixed and the print medium 48 moved relative to it, creating an image as wide as the printhead 44 in a single pass. The printhead 44 can be narrower than, or as wide as, the print medium 48. In another embodiment, the printhead 44 can print to an intermediate surface such as a rotating drum or belt (not depicted for simplicity) for subsequent transfer to a print medium 48.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. An electrostatic ink jet printhead comprising a plurality of electrostatic actuators, wherein each electrostatic actuator comprises:

a substrate assembly;

a gap standoff layer attached to the substrate assembly, wherein:

the gap standoff layer comprises a first section and a second section spaced from the first section; and the first section of the gap standoff layer and second section of the gap standoff layer each have a first width;

an actuator electrode attached to the substrate assembly and interposed between the first section of the gap standoff layer and the second section of the gap standoff layer within an actuator air chamber;

an actuator membrane attached to the first section of the gap standoff layer and to the second section of the gap standoff layer;

a body layer attached to the actuator membrane, wherein:

the body layer comprises a first section and a second section spaced from the first section of the body layer;

a distance from the first section of the body layer to the second section of the body layer determines a width of an ink chamber; and the first section of the body layer and the second section of the body layer each have a second width that is wider than the first width; and a nozzle plate comprising an actuator nozzle through which ink is ejected during printing.

2. The electrostatic ink jet printhead of claim 1, wherein the second width is from 1.2 times to 5.0 times the first width.

3. The electrostatic ink jet printhead of claim 2, wherein the ink chamber is defined, at least in part, by the nozzle plate, the first and second sections of the body layer, and the actuator membrane.

4. The electrostatic ink jet printhead of claim 3, further comprising:

a first membrane node for the actuator membrane, wherein the first membrane node is defined by the first section of the body layer; and a second membrane node for the actuator membrane, wherein the second membrane node is defined by the second section of the body layer.

5. The electrostatic ink jet printhead of claim 4, wherein:

a portion of the first section of the body layer directly vertically overlies a portion of the first section of the gap standoff layer; and a center of the first section of the body layer does not directly vertically overlie a center of the first section of the gap standoff layer.

6. The electrostatic ink jet printhead of claim 1, wherein:

the first width is from 3 μm to about 70 μm; and the second width is from 20 μm to 100 μm.

7. An ink jet printer, comprising:

at least one electrostatic ink jet printhead comprising a plurality of electrostatic actuators, wherein each electrostatic actuator comprises:

a substrate assembly;

a gap standoff layer attached to the substrate assembly, wherein:

the gap standoff layer comprises a first section and a second section spaced from the first section; and the first section of the gap standoff layer and second section of the gap standoff layer each have a first width;

an actuator electrode attached to the substrate assembly and interposed between the first section of the gap standoff layer and the second section of the gap standoff layer within an actuator air chamber;

an actuator membrane attached to the first section of the gap standoff layer and to the second section of the gap standoff layer;

a body layer attached to the actuator membrane, wherein:

the body layer comprises a first section and a second section spaced from the first section of the body layer;

a distance from the first section of the body layer to the second section of the body layer determines a width of an ink chamber; and the first section of the body layer and the second section of the body layer each have a second width that is wider than the first width;

a nozzle plate comprising an actuator nozzle through which ink is ejected during printing; and a printer housing that encases the at least one electrostatic ink jet printhead.

8. The ink jet printer of claim 7, wherein the second width is from 1.2 times to 5.0 times the first width.

9. The ink jet printer of claim 8, wherein a distance from the first section of the body layer to the second section of the body layer defines an ink chamber from which ink is ejected through the actuator nozzle during printing.

10. The ink jet printer of claim 9, further comprising:

a first membrane node for the actuator membrane, wherein the first membrane node is defined by the first section of the body layer; and a second membrane node for the actuator membrane, wherein the second membrane node is defined by the second section of the body layer.

11. The ink jet printer of claim 10, wherein:

a portion of the first section of the body layer directly vertically overlies a portion of the first section of the gap standoff layer; and a center of the first section of the body layer does not directly vertically overlie a center of the first section of the gap standoff layer.

12. The ink jet printer of claim 7, wherein:

the first width is from 3 μm to about 70 μm; and the second width is from 20 μm to 100 μm.

13. A method for forming an electrostatic ink jet printhead comprising a plurality of electrostatic actuators, the method comprising:

forming a gap standoff layer having a first section and a second section attached to a substrate assembly, wherein the first section of the gap standoff layer and second section of the gap standoff layer each have a first width;

forming an actuator electrode attached to the substrate assembly and interposed between the first section of the gap standoff layer and the second section of the gap standoff layer;

attaching an actuator membrane to the first section of the gap standoff layer and to the second section of the gap standoff layer to form an actuator air chamber, wherein the actuator electrode is within the actuator air chamber;

forming a body layer attached to the actuator membrane, wherein the body layer comprises a first section and a second section spaced from the first section of the body layer, and a distance from the first section of the body layer to the second section of the body layer determines a width of an ink chamber; and forming the first section of the body layer and the second section of the body layer to each have a second width that is wider than the first width; and attaching a nozzle plate to the body layer, wherein the nozzle plate comprises an actuator nozzle through which ink is ejected during printing.

14. The method of claim 13, further comprising forming the first section and the second section of the body layer to have a second width that is from 1.2 times to 5.0 times the first width.

15. The method of claim 14, wherein the attachment of the nozzle plate at least in part forms the ink chamber defined by the nozzle plate, the first and second sections of the body layer, and the actuator membrane.

16. The method of claim 15, further comprising:

forming a first membrane node for the actuator membrane during the formation of the first section of the body layer; and forming a second membrane node for the actuator membrane during the formation of the second section of the body layer.

17. The method of claim 16, further comprising:

forming a portion of the first section of the body layer to directly vertically overlie a portion of the first section of the gap standoff layer; and forming a center of the first section of the body layer such that the center does not directly vertically overlie a center of the first section of the gap standoff layer.

18. The method of claim 13, further comprising:

forming the first section of the gap standoff layer and the second section of the gap standoff layer such that the first width is from 3 μm to about 70 μm; and forming the first section of the body layer and the second section of the body layer such that the second width is from 20 μm to 100 μm.

* * * * *